US008156943B1

(12) United States Patent
Bray

(10) Patent No.: US 8,156,943 B1
(45) Date of Patent: Apr. 17, 2012

(54) METHOD FOR OPENING A SMOKE PASSAGE IN A CIGAR AND TOOL THEREFOR

(76) Inventor: Craig A. Bray, Redlands, CA (US)

( * ) Notice: Subject to any disclaimer, the term of this patent is extended or adjusted under 35 U.S.C. 154(b) by 416 days.

(21) Appl. No.: 12/455,526

(22) Filed: Jun. 3, 2009

Related U.S. Application Data

(63) Continuation-in-part of application No. 11/206,982, filed on Aug. 18, 2005, now abandoned.

(60) Provisional application No. 60/609,524, filed on Sep. 13, 2004.

(51) Int. Cl.
*A24F 13/24* (2006.01)

(52) U.S. Cl. ..... 131/255

(58) Field of Classification Search ..... 131/255
See application file for complete search history.

(56) References Cited

U.S. PATENT DOCUMENTS 2,333,049 A * 10/1943 Shapiro ..... 131/300
4,623,335 A * 11/1986 Jackson ..... 604/118
5,836,318 A * 11/1998 Adams ..... 131/253

OTHER PUBLICATIONS

Applicants' statement regarding first advertisement and sale date of the invention disclosed in U.S. Appl. No. 11/206,982, Aug. 26, 2009.

* cited by examiner

*Primary Examiner* — Matthew Daniels
*Assistant Examiner* — Yana Belyaev
(74) *Attorney, Agent, or Firm* — Ted Masters

(57) ABSTRACT

A method for opening a smoke passage in a cigar includes using a tool which has a tube which is connected to an air supply. The tube has an air exit aperture(s) which exhausts air delivered by the air supply. The tube is inserted into a cigar and the air supply is operated. The air blows out a passageway within the cigar so that the cigar will draw when smoked.

7 Claims, 7 Drawing Sheets

40
34
20
22
600
30
28
500
502

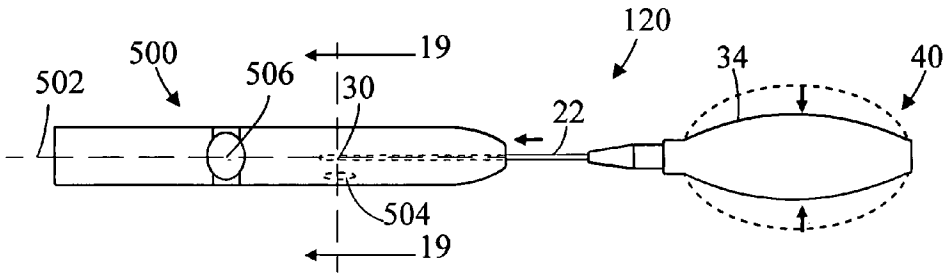
Fig-17
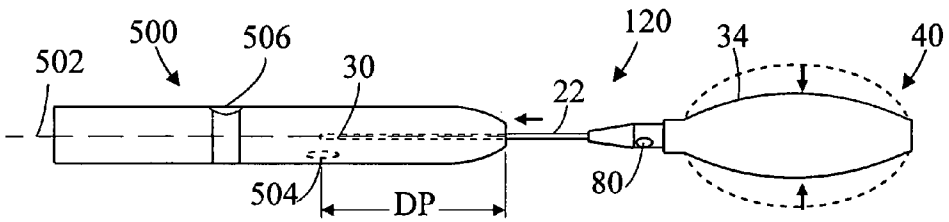
Fig-18
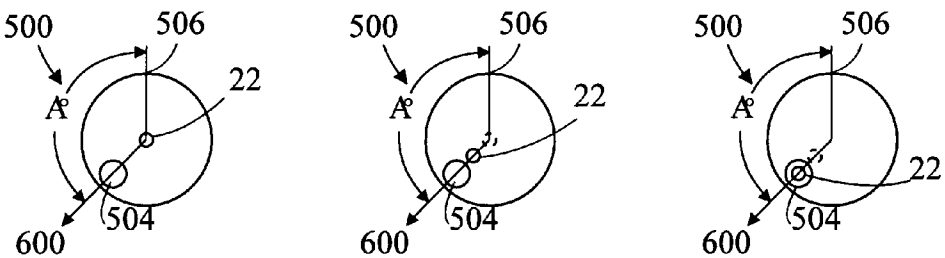
Fig-19
Fig-20
Fig-21

METHOD FOR OPENING A SMOKE PASSAGE IN A CIGAR AND TOOL THEREFOR

CROSS REFERENCE TO RELATED APPLICATION

This application is a continuation-in-part of and claims the filing benefit under 35 U.S.C. §120 of application Ser. No. 11/206,982, filed Aug. 18, 2005, now abandoned which claims the filing benefit under 35 U.S.C. §119(e) of provisional application No. 60/609,524, filed Sep. 13, 2004, all of which previously filed applications are hereby incorporated by reference.

TECHNICAL FIELD

The present invention pertains generally to smoking, and more particularly to smoking cigars which are tightly rolled, wherein a tool may be used to open a smoke passage in the cigar.

BACKGROUND OF THE INVENTION

Some cigars, particularly hand rolled cigars, are tightly packed or have some other passage anomaly and therefore do not draw easily. A current remedy for this situation is to insert an elongated object such as a straightened paper clip into the cigar and attempt to open a smoke passage. Unfortunately, many times such operations lead to the destruction of the cigar.

BRIEF SUMMARY OF THE INVENTION

The present invention is directed to a method and tool for opening a passage for smoke in a cigar so that the cigar will draw more easily. The invention is particularly useful with hand rolled cigars which are oftentimes tightly packed. An air supply such as a squeeze bulb pump is attached to a tube (hollow elongated needle) having at least one air exit hole. The tube is longitudinally inserted into the cigar and the pump is squeezed thereby forcing air into the center of the cigar. The pressure of the air forces open passages for smoke to flow so that the cigar will draw properly.

In accordance with a preferred embodiment of the invention, a method for opening a smoke passage in a cigar includes:

(a) providing a cigar having a longitudinal axis;

(b) providing a tool for opening a smoke passage in the cigar, the tool including:

a tube having a first end having an air entry aperture, an opposite second end, at least one air exit aperture, and a tube longitudinal axis;

an air supply connected to the first end of the tube so that when the air supply is operated air is forced into the air entry aperture and exits through the at least one air exit aperture;

(c) inserting the second end of the tube into the cigar so that the at least one air exit aperture resides within the cigar; and, (d) operating the air supply thereby forcing air out the at least one air exit aperture and into the cigar.

The method further including:

in step (c), stopping the insertion when resistance is felt.

The method further including:

in step (d), operating the air supply a plurality of times.

The method further including:

in step (d), rotating the cigar with respect to the tube between operations of the air supply.

The method further including:

in step (c), inserting the tube a distance into the cigar and then performing step (d); and, then inserting the tube an additional distance into the cigar and again performing step (d).

The method further including:

in step (b), the air supply being a squeeze bulb pump.

The method further including:

in step (b), the at least one air exit aperture including the second end of the tube being open.

The method further including:

in step (b), providing a rod dimensioned to be received by the second end of the tube, the rod for removing obstructions from said tube; and, before step (c), inserting the rod into the second end of the tube.

The method further including:

in step (b), the tube having a side; and, the at least one air exit aperture disposed on the side of the tube near the second end of the tube.

The method further including:

in step (b), the tool including a registration mark which is oriented in the same direction as the air exit passage, the registration mark being locatable by at least one of visual and tactile means;

in step (d), operating the air supply a plurality of times;

in step (d), rotating the cigar with respect to the tube between operations of the air supply; and, in step (d), using the registration mark to direct the air in a desired direction.

The method further including:

in step (d), locating the registration mark by visual means.

The method further including:

in step (d), locating the registration mark by tactile means.

The method further including:

in step (b), the plurality of air exit apertures being three air exit apertures.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 17 is a top plan view of a cigar having a plug;

FIG. 18 is a side elevation view of the cigar of FIG. 17;

FIG. 19 is a cross sectional view along the line 19-19 of FIG. 17;

FIG. 20 is another cross sectional view along the line 19-19 of FIG. 17; and, FIG. 21 is another cross sectional view along the line 19-19 of FIG. 17.

DETAILED DESCRIPTION OF THE INVENTION

Figure 1:
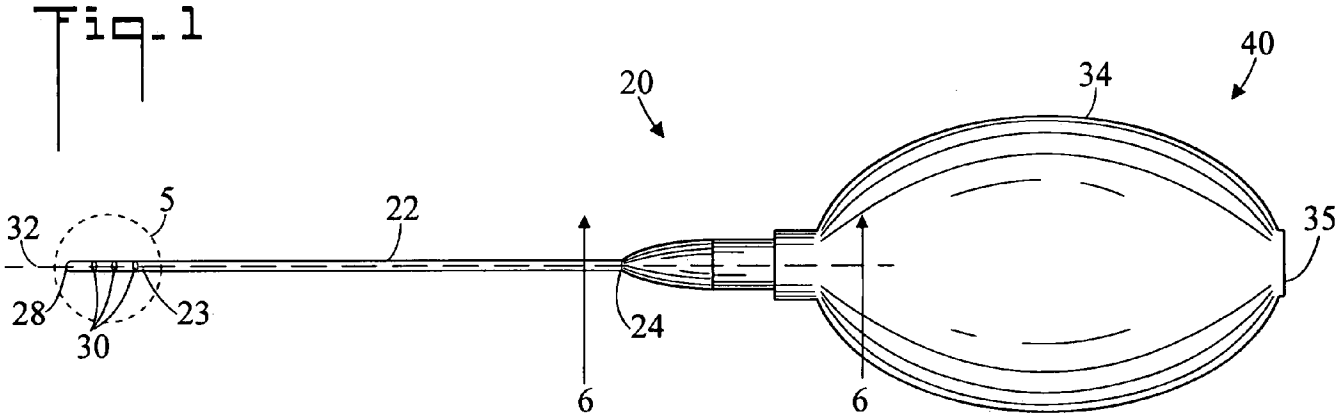
FIG. 1 is top plan view of a tool for opening a smoke passage in a cigar in accordance with the present invention.
Figure 2:
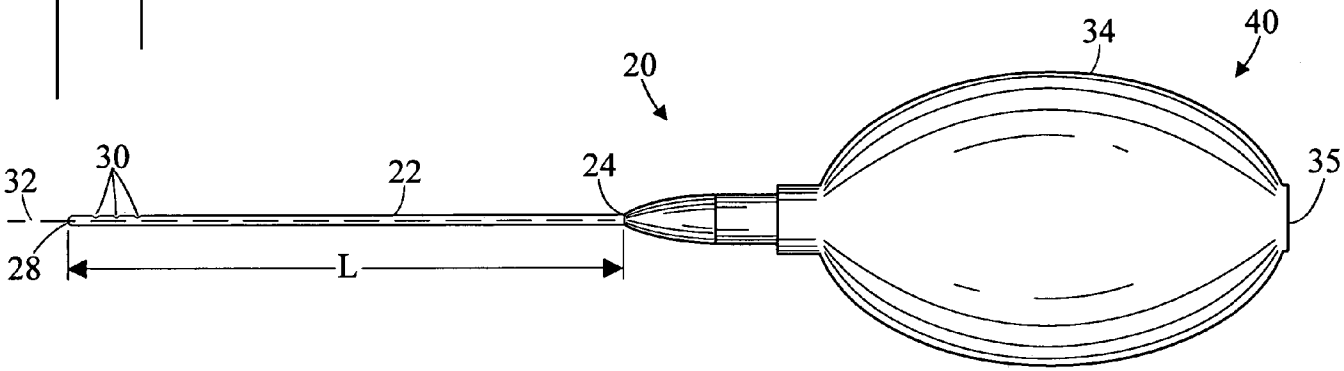
FIG. 2 is a side elevation view of the tool.
Figure 4:
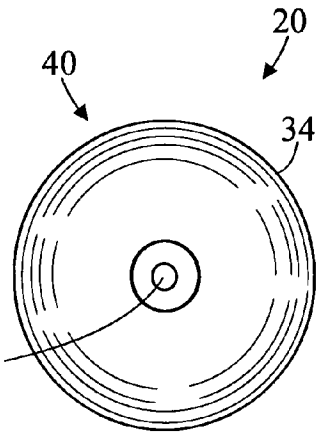
FIG. 4 is an opposite end view.
Figure 3:
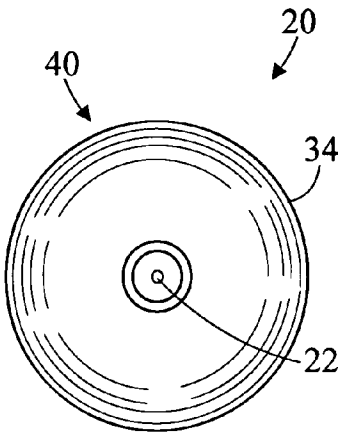
FIG. 3 is end view of the tool.

Referring initially to FIGS. 1-4 there are illustrate top plan, side elevation, end, and opposite end views respectively of a tool for opening a smoke passage in a cigar accordance with the present invention, generally designated as 20. Refer also to FIGS. 8-10 to view tool 20 inserted along the longitudinal axis 502 of a cigar 500. Tool 20 includes an elongated tube 22 having a first end 24 having an air entry aperture 26 (refer also to FIG. 6), an opposite second end 28, at least one air exit aperture 30, and a tube longitudinal axis 32. In the shown embodiment, tube has a side 23, and the at least one air exit aperture 30 includes a plurality of air exit apertures 30 disposed on side 23 of tube 22 near second end 28 of tube 22. Three air exit apertures 30 have been found useful in providing an effective air flow to open a smoke passage in cigar 500. In an embodiment of the invention, tube 22 is at least three inches long so that it can reach well into cigar 500 (refer also to FIGS. 8-10). Tube 22 is preferably fabricated from a non-corrosive metal or from a ridged polymer, and is about 3.5 inches long so that it can accommodate a 7 inch cigar if inserted from both ends.

An air supply 40 is connected to first end 24 of tube 22 so that when air supply 40 is operated air is forced into air entry aperture 26 (refer to FIG. 6) and exits through the at least one air exit aperture 30. In the shown embodiment air supply 40 is a squeeze bulb pump 34 having a one-way air valve 35 such as is used in blood pressure devices. Air may enter squeeze bulb pump 34 through air valve 35, but cannot exit through air valve 35. Rather the air is forced out an exit port 36 in squeeze bulb pump 34 and into entry port 26 of tube 22 (refer also to FIG. 6). It may be appreciated that other air supplies 40 such as a canister of pressurized air could also be used in the present invention. Also, a gas other than air could be utilized to implement the present invention.

Figure 5:
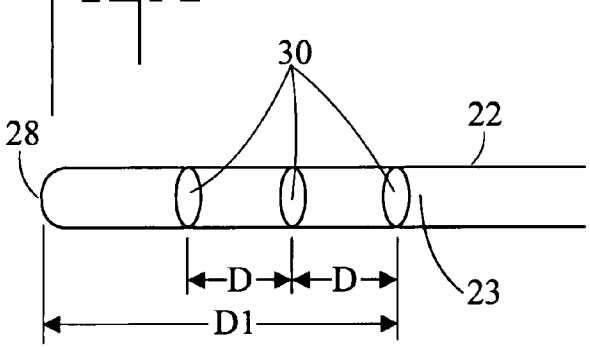
FIG. 5 is an enlarged view of area 5 of FIG. 1.

FIG. 5 is an enlarged view of area 5 of FIG. 1. A spacing D of about 0.125 inches between air exit apertures 30 has been found useful. Also, locating air exit aperture(s) 30 within a distance D1 of about 0.5 inches of second end 28 is preferred in order to provide air well into cigar 500. It is noted that in this embodiment second end 28 of tube 22 is closed.

Figure 6:
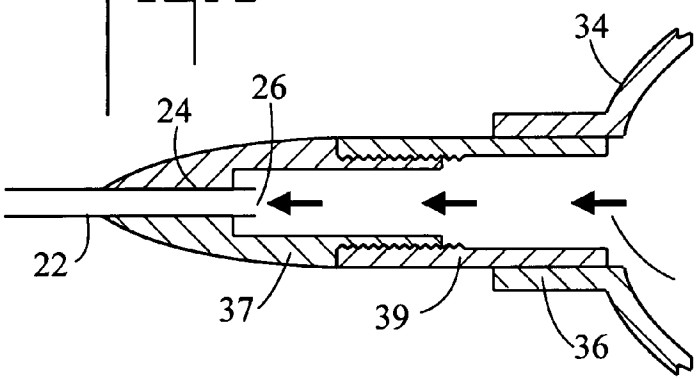
FIG. 6 is an enlarged cross sectional view along the line 6-6 of FIG. 1.
Figures 7, 8, 9, 10:
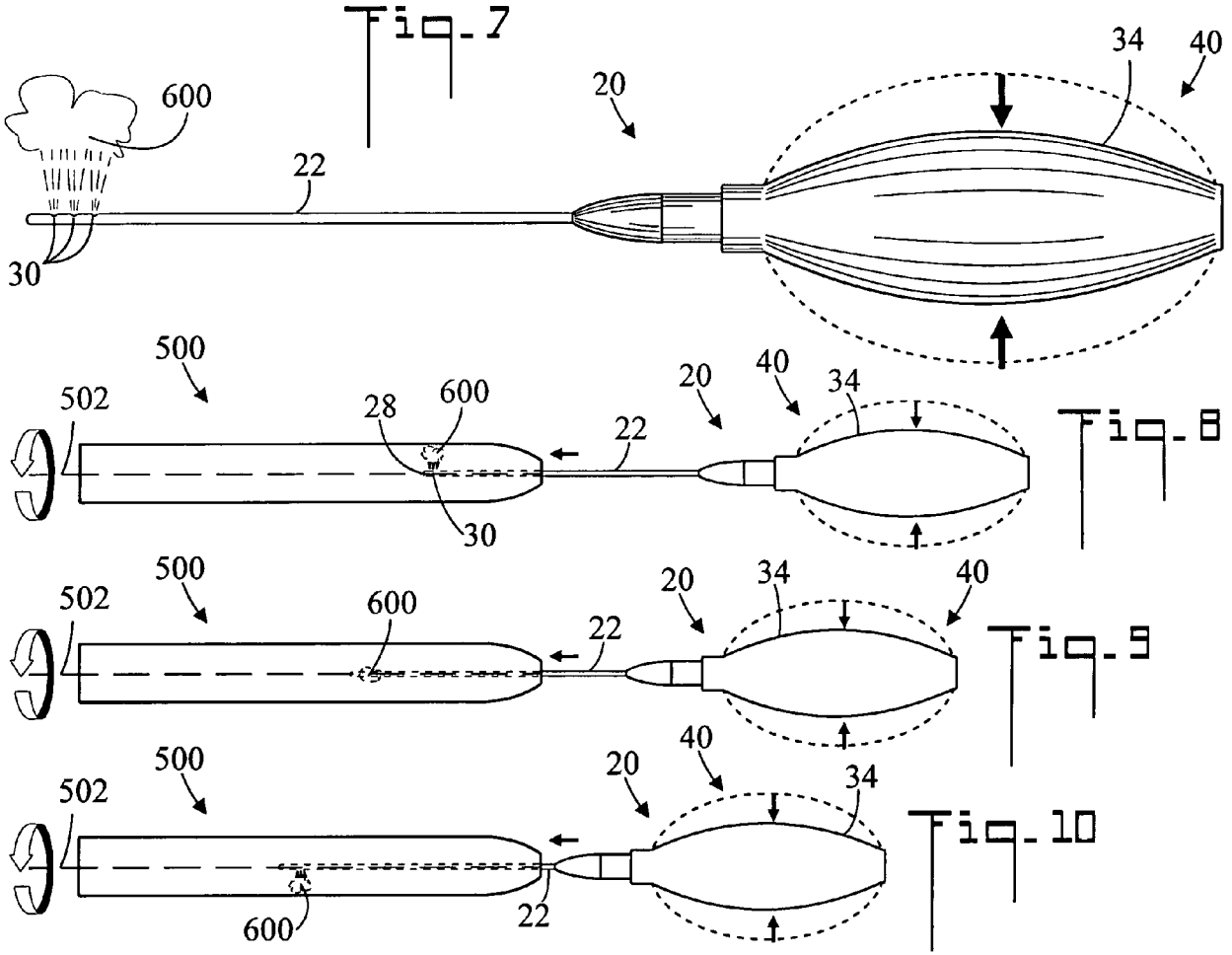
FIG. 7 is a side elevation view of the tool with an air supply being operated.
FIG. 8 is a reduced side elevation view of the tool inserted a distance into a cigar.
FIG. 9 is a reduced side elevation view of the tool inserted an additional distance into the cigar.
FIG. 10 is a reduced side elevation view of the tool inserted yet an additional distance into the cigar.

FIG. 6 is a enlarged cross sectional view along the line 6-6 of FIG. 1. In the shown embodiment air supply 40 (squeeze bulb pump 34) is removably connected to first end 24 of tube 22. The connection is effected by a threaded cone-shaped connector 37 which is fixedly connected to first end 24 of tube 22. A threaded fitting 39 is connected to exit port 36 of squeeze bulb pump 34, and threadably accepts threaded cone-shaped connector 37.

FIG. 7 is a side elevation view of tool 20 with air supply 40 (squeeze bulb pump 34) being operated. Squeeze bulb pump 34 is compressed by the hand of a user thereby forcing air 600 out air exit apertures 30. Because air exit apertures 30 are disposed on the side 23 of tube 22, air 600 is directed substantially perpendicular to tube longitudinal axis 32.

FIG. 8 is a reduced side elevation view of tool 20 inserted a distance into cigar 500.

Second end 28 of tube 22 is inserted along longitudinal axis 502 of cigar 500. Air supply 40 (squeeze bulb pump 34) is then operated thereby forcing air 600 out the at least one exit aperture 30 and into cigar 500. The air 600 opens a smoke passage in cigar 500 so that it will draw. In the shown embodiment, operating air supply 40 means squeezing squeeze bulb pump 34. During insertion of tube 22, it is best to stop the insertion process when resistance from the tightly packed cigar 500 is felt. Then air supply 40 is operated a plurality of times, such as three or four, to clear a smoke passage. Cigar 500 should be rotated between operations of air supply 40 to clear a passage completely around tube 22. For example, cigar 500 could be rotated 90° between squeezes. Alternatively, tube 22 could be rotated.

FIG. 9 is a reduced side elevation view of tool 20 inserted an additional distance into the cigar 500, and FIG. 10 is a reduced side elevation view of tool 20 inserted yet an additional distance into cigar 500. After a smoke passage is cleared at one location inside cigar 500, the user continues to insert tube 22 of tool 20 an additional distance into cigar 500 until more resistance is met, and repeats the operation of air supply 40 and the rotation of cigar 500. This process is repeated a desired number of times until a continuous smoke passage has been cleared inside cigar 500.

Figure 11:
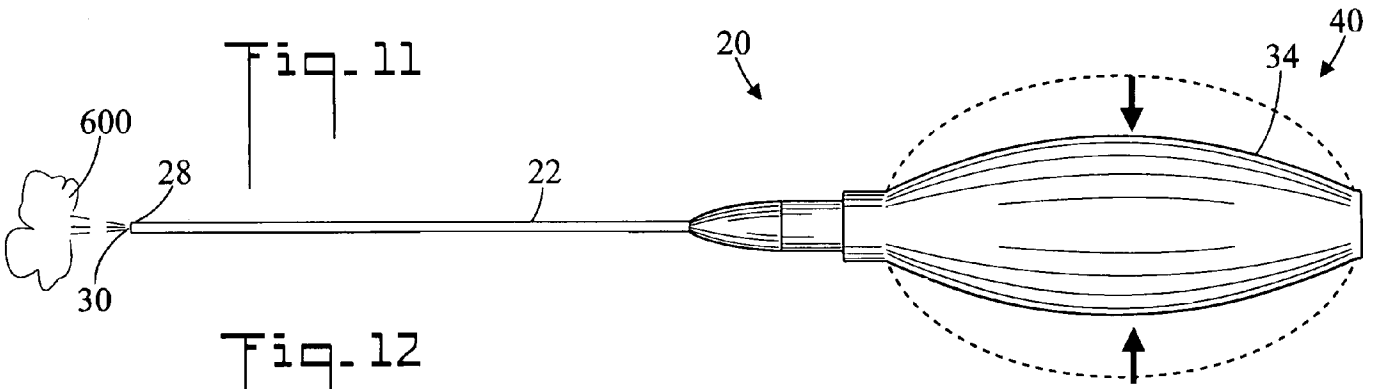
FIG. 11 is a side elevation view of a second embodiment of the tool.

FIG. 11 is a side elevation view of a second embodiment of tool 20. In this embodiment, at least one air exit aperture 30 includes second end 28 of tube 22 being open, so that air 600 is expelled straight out second end 28 of tube 22 along tube longitudinal axis 32.

Figure 12:
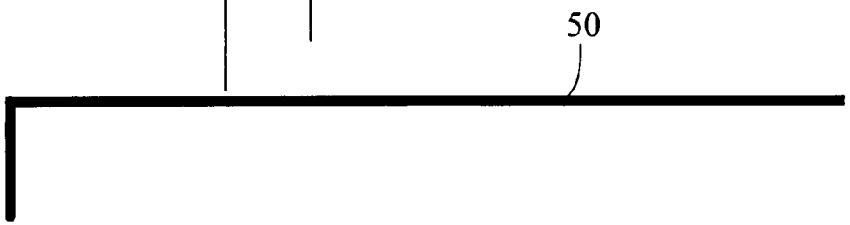
FIG. 12 is a side elevation view of a rod.

FIG. 12 is a side elevation view of a rod 50 which is dimensioned to be received by tube 22. Rod 50 is used to remove obstructions from tube 22. The obstructions occur because in this embodiment air exit aperture 30 is located at the end of tube 22 and can become clogged during insertion into cigar 500.

Figure 13:
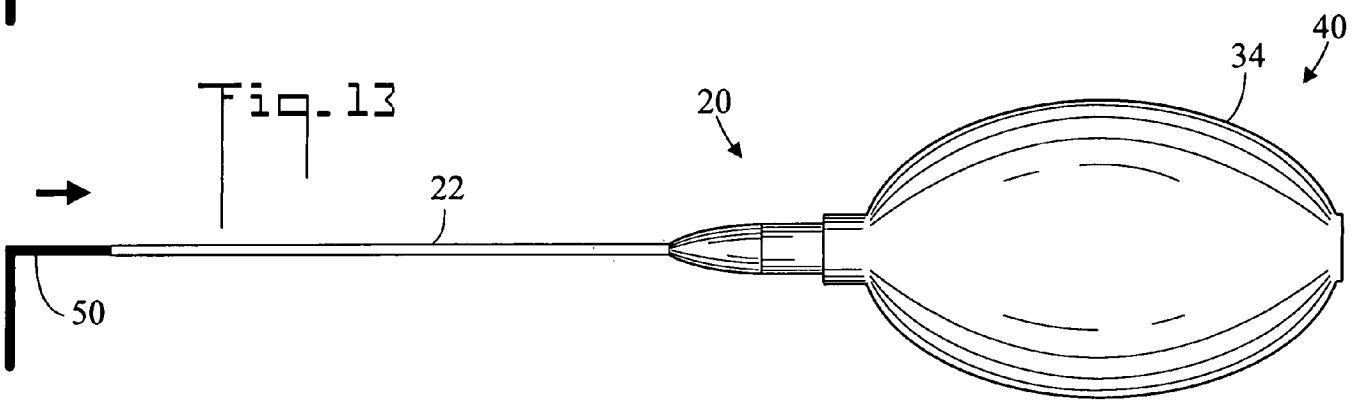
FIG. 13 is a side elevation view of the rod inserted into the tube of the tool.

FIG. 13 is a side elevation view of rod 50 inserted into tube 22 of the tool 20 for the purpose of cleaning the bore of tube 22.

Figure 14:
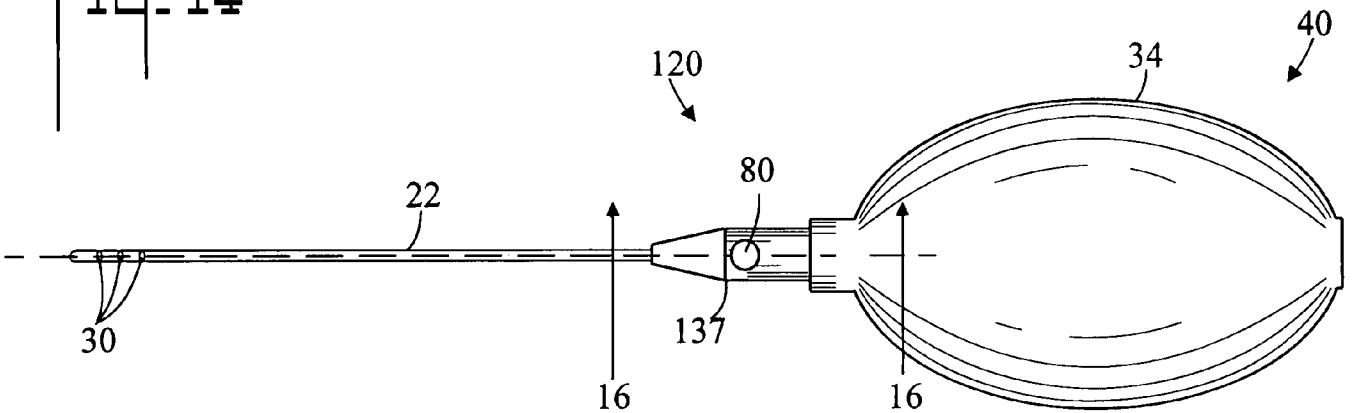
FIG. 14 is a top plan view of a second embodiment of the tool.
Figure 15:
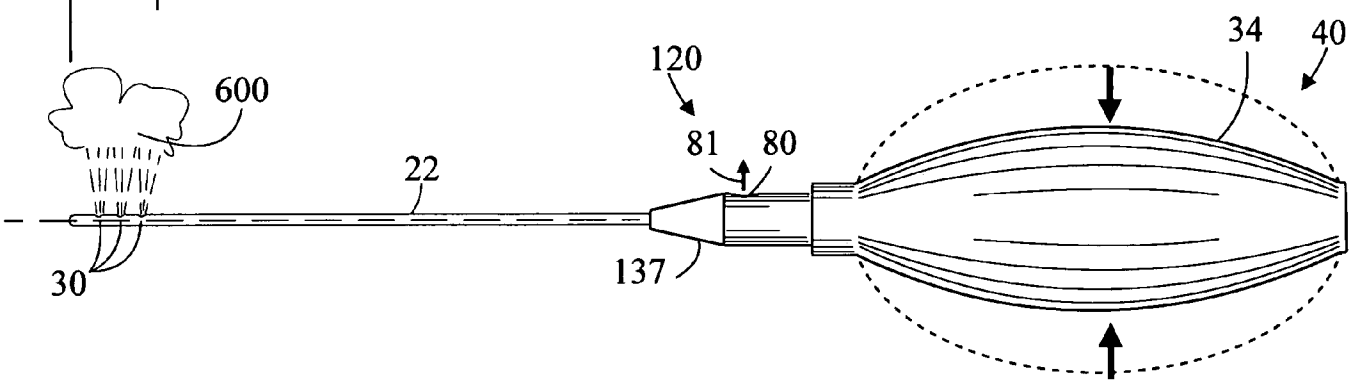
FIG. 15 is a side elevation view of the second embodiment with the air supply being operated.

FIG. 14 is a top plan view of a second embodiment of the tool of the present invention, generally designated as 120, and FIG. 15 is a side elevation view of tool 120 with the air supply 40 being operated. Tool 120 is identical to tool 20 except (1) tool 120 includes a registration mark 80, and (2) in tool 120 the connection of squeeze bulb pump 34 to tube 22 is effected by a different connector 137 (refer to FIG. 16 and the associated discussion). Registration mark 80 is located on connector 137 and is oriented in the same direction as the plurality of air exit passages 30 (refer to arrow 81). That is, registration mark faces in the same direction as air exit passages 30, so that a user knows in which direction air exit passages 30 are facing, and can direct air 600 in a desired direction. This is useful since when tube 22 is inserted into a cigar 500 (refer to FIGS. 17-21 and the associated discussion) exit passage(s) 30 is inside cigar 500 and cannot be viewed. In the shown embodiment, registration mark 80 is a circular indentation in connector 137. Registration mark 80 is locatable by at least one of visual and tactile means. Or in other words, the user and either look at registration mark 80 or feel registration mark 80 to know in which direction air 600 is being forced out of air exit passages 30.

Figure 16:
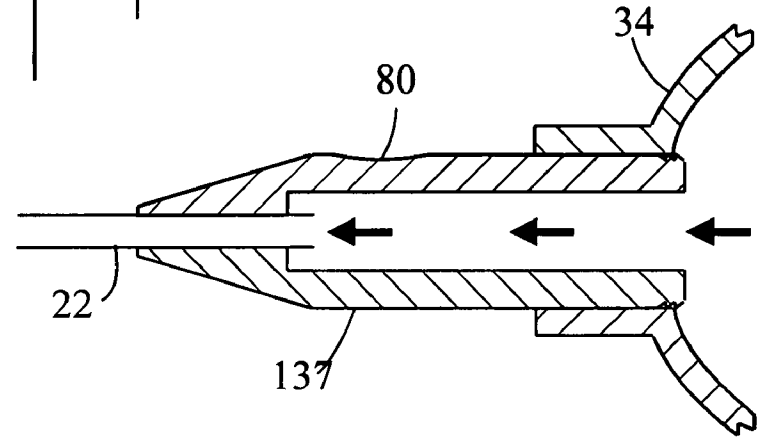
FIG. 16 is an enlarged cross sectional view along the line 16-6 of FIG. 14.

FIG. 16 is an enlarged cross sectional view along the line 16-6 of FIG. 14. Connector 137 connects tube 22 to squeeze bulb pump 34 without any threaded elements as in FIG. 6. Connector 137 is fixedly connected to tube 22 to maintain the registration relationship of air exit passages 30 and registration mark 80. It is noted that connector 137 is barbed where it receives squeeze bulb pump 34.

Cigar 500 is typically made in three parts. The centrally located filler is a bundle of individual leaves forming individual air passages that run the length of cigar 500. The binder is usually one or two leaves which are rolled around the filler. The outer wrapper comprises a solid single leaf which is rolled around the binder and creates the outer shell of cigar 500. As a result of the manufacturing process, cigar 500 may have one or more internal plugs (restrictions) 504 which impedes the flow of smoke. Plugs 504 can result from (1) rolling cigar 500 too tightly, (2) an obstruction such as a stem is rolled into cigar 500, or (3) the filler has a twist or kink as a result of the rolling process. When the air exit aperture 30 of the present invention encounters a plug 504, resistance will be encountered in operating air supply 40, and air does not freely flow into cigar 500. For example if air supply 40 is squeeze bulb pump 34, then the pump will be more difficult to squeeze when a plug 504 is encountered.

FIGS. 17-18 are reduced top plan and side elevation views respectively of a cigar 500 having a plug 504 which causes resistance to the flow of air from air supply 40 (in the shown embodiment a squeeze bulb pump 34). Tube 22 is inserted into cigar 500 and squeeze bulb 34 is operated. Because of plug 504 resistance is encountered in the operation of squeeze bulb pump 34. Plug 504 is located by first using tube 22 as a guide to determine the depth DP of plug 504. That is, the length of tube 22 which is inserted into cigar 500 corresponds to the depth DP of plug 504. The angular direction A of plug 504 is then determined by using registration mark 80 to show which direction exit aperture(s) 30 is pointed, and comparing that direction with the orientation of cigar band 506. It is noted that angular direction A is measured from the center of the enlarged label portion of cigar band 506.

FIG. 19 is a cross sectional view along the line 19-19 of FIG. 17, and illustrates the process for determining the angular direction A of plug 504. Plug 504 impedes the flow of air from air exit aperture(s) 30 which is pointed in the direction of air flow 600. Angular direction A in degrees is measured from the label portion of cigar band 506 to the direction of resistance (about 120 degrees in the shown example).

FIG. 20 is a cross sectional view as in FIG. 19, and illustrates the process of clearing plug 504. Once the depth D and angular direction A of plug 504 have been determined, tube 22 is removed from cigar 500 and then re-inserting along the angular direction A toward the resistance of plug 504. The previous position of tube 22 is shown in dashed lines, and the re-inserted position is shown between the previous position and plug 504. Tube 22 is then longitudinally moved back and forth (i.e. parallel to cigar longitudinal axis 502). Squeeze bulb pump 34 (air supply 40) is then operated to determine if the resistance has been eliminated. In FIG. 20, tube 22 was re-inserted short of plug 504, so resistance will still be encountered. As such, in FIG. 21 tube 22 is again removed and re-inserted, again in angular direction A toward plug 504. This time tube 22 is inserted through plug 504, thereby clearing the plug and opening a path for the smoke.

In term's of use, a method for opening a smoke passage in a cigar 500 includes: (refer to FIGS. 1-16):

(a) providing a cigar 502 having a longitudinal axis 502;

(b) providing a tool 20, 120 for opening a smoke passage in cigar 500, tool 20, 120 including:

a tube 22 having a first end 24 having an air entry aperture 26, an opposite second end 28, at least one air exit aperture 30, and a tube longitudinal axis 32;

an air supply 40 connected to first end 24 of tube 22 so that when air supply 40 is operated air 600 is forced into air entry aperture 26 and exits through the at least one air exit aperture 30;

(c) inserting the second end 28 of tube 22 into cigar 500, so that tube longitudinal axis 32 is approximately parallel to cigar longitudinal axis 502, and so that the at least one air exit aperture 30 resides within cigar 500; and, (d) operating air supply 40 thereby forcing air 600 out the at least one air exit aperture 30 and into cigar 500. (refer to FIG. 8)

The method further including:

in step (c), stopping the insertion when resistance is felt.

The method further including:

in step (d), operating air supply 40 a plurality of times.

The method further including:

in step (d), rotating cigar 500 with respect to tube 22 between operations of air supply 40. It is noted that this rotation can be effected by rotating cigar 500 while holding tube 22 stationary, or rotating tube 22 while holding cigar 500 stationary, or even by rotating both cigar 500 and tube 22.

The method further including:

in step (c), inserting tube 22 a distance into cigar 500 and then performing step (d); and, then inserting tube 22 an additional distance into cigar 500 and again performing step (d). (refer to FIGS. 9 and 10)

The method further including:

in step (b), air supply 40 being a squeeze bulb pump 34.

The method further including:

in step (b), the at least one air exit aperture 30 including second end 28 of tube 22 being open.

The method further including:

in step (b), providing a rod 50 dimensioned to be received by second end 28 of tube 22, rod 50 for removing obstructions from tube 22; and, before step (c), inserting rod 50 into second end 28 of tube 22.

The method further including:

in step (b), tube 22 having a side 23; and, the at least one air exit aperture 30 disposed on side 23 of tube 22 near second end 28 of tube 22.

The method further including:

in step (b), tool 120 including a registration mark 80 which is oriented in the same direction as the at least one air exit passage 30, registration mark 80 being locatable by at least one of visual and tactile means;

in step (d), operating air supply 40 a plurality of times;

in step (d), rotating cigar 500 with respect to tube 22 between operations of air supply 40; and, in step (d), using registration mark 80 to direct air 600 in a desired direction.

The method further including:

in step (d), locating registration mark 80 by visual means.

The method further including:

in step (d), locating registration mark 80 by tactile means.

The method further including: in step (b), the plurality of air exit apertures 30 being three air exit apertures.

Another method for opening a smoke passage in a cigar 500 includes: (refer to FIGS. 1-21)

(a) providing a cigar 500 having a longitudinal axis 502 and a cigar band 506;

(b) providing a tool 120 for opening a smoke passage in cigar 500, tool 120 including:

a tube 22 having a first end 24 having an air entry aperture 26, an opposite second end 28, at least one air exit aperture 30, a tube longitudinal axis 32, and a side 23;

the at least one air exit aperture 30 disposed on side 23 of tube 22 near second end 28 of tube 22;

an air supply 40 connected to first end 24 of tube 22 so that when air supply 40 is operated air 600 is forced into air entry aperture 26 and exits through the at least one air exit aperture 30;

tool 20 including a registration mark 80 which is oriented in the same direction as the at least one air exit aperture 30, registration mark 80 being locatable by at least one of visual and tactile means;

(c) inserting second end 28 of tube 22 into cigar 500, so that tube longitudinal axis 32 is approximately parallel to cigar longitudinal axis 502, and so that the at least one air exit aperture 30 resides within cigar 500; and, (d) operating air supply 40 thereby forcing air 600 out the at least one air exit aperture 30 and into cigar 500.

The method further including:

in step (d) if resistance (such as from a plug) is encountered, locating the depth DP and angular direction A of the resistance as follows:

(1) using tube 22 as a guide, determining the depth DP of the resistance; (refer to FIG. 18) and, (2) using cigar band 506 and registration mark 80 as guides, determining the angular direction of the resistance. (refer to FIG. 19)

The method further including:

after locating the depth DP and the angular direction A of the resistance, removing tube 22 from cigar 500 and re-inserting tube 22 along the angular direction toward the resistance; (refer to FIGS. 20-21)

moving tube 22 longitudinally back and forth; and, operating air supply 40 to determine if the resistance has been eliminated. If the resistance is still present, then the steps of locating the depth DP and angular direction A of the resistance, and re-insertion/moving back and forth of tube 22 are repeated until resistance is absent and therefore the plug has been cleared.

It is lastly noted that a lit cigar 500 can be conveniently stoked by using the present invention. To do this tube 22 is inserted into cigar 500 and air supply 40 is operated as tube 22 is moved along the length of cigar 500.

The preferred embodiments of the invention described herein are exemplary and numerous modifications, variations, and rearrangements can be readily envisioned to achieve an equivalent result, all of which are intended to be embraced within the scope of the appended claims.

I claim:

1. A method for opening a smoke passage in a cigar, comprising:

(a) providing a cigar having a longitudinal axis;

(b) providing a tool for opening a smoke passage in said cigar, said tool including:

tube having a first end having an air enter aperture, an opposite second end, at least one air exit aperture, and a tube longitudinal axis;

said at least one air exit aperture including said second end of said tube being open an air supply connected to said first end of said tube so that when said air supply is operated air is forced into said air entry aperture and exits through said at least one air exit aperture;

a rod dimensioned to be received by said second end of said tube;

(c) inserting said rod into said second end of said tube;

(d) inserting said second end of said tube into said cigar so that the at least one air exit aperture resides within said cigar; and, (e) operating said air supply thereby forcing air out said at least one air exit aperture and into said cigar.

2. A method for opening a smoke passage in a cigar, comprising:

(a) providing a cigar having a longitudinal axis;

(b) providing a tool for opening a smoke passage in said cigar, said tool including:

a tube having a first end having an air entry aperture, an opposite second end, at least one air exit aperture, and a tube longitudinal axis;

said tube having a side, and said at least one air exit aperture disposed on said side of said tube;

said tool including a registration mark which is oriented in the same direction as said at least one air exit aperture, said registration mark being locatable by at least one of visual and tactile means;

an air supply connected to said first end of said tube so that when said air supply is operated air is forced into said air entry aperture and exits through said at least one air exit aperture;

(c) inserting said second end of said tube into said cigar so that the at least one air exit aperture resides within said cigar;

(d) operating said air supply a plurality of times thereby forcing air out said at least one air exit aperture and into said cigar;

(e) in (d), rotating said cigar with respect to said tube between operations of said air supply; and, (f) in (d), using said registration mark to direct said air in a desired direction.

3. The method of claim 2, further including:

in (d), locating said registration mark by visual means.

4. The method of claim 2, further including:

in (d), locating said registration mark by tactile means.

5. A method for opening a smoke passage in a cigar, comprising:

(a) providing a cigar having a longitudinal axis and a cigar band;

(b) providing a tool for opening a smoke passage in said cigar, said tool including:

a tube having a first end having an air entry aperture, an opposite second end, at least one air exit aperture, and a tube longitudinal axis;

said tube having a side;

said at least one air exit aperture disposed on said side of said tube;

an air supply connected to said first end of said tube so that when said air supply is operated air is forced into said air entry aperture and exits through said at least one air exit aperture;

said tool including a registration mark which is oriented in the same direction as said at least one air exit aperture, said registration mark being locatable by at least one of visual and tactile means;

(c) inserting said second end of said tube into said cigar so that the at least one air exit aperture resides within said cigar; and, (d) operating said air supply thereby forcing air out said at least one air exit aperture and into said cigar.

6. The method of claim 5, further including:

in (d) if resistance is encountered, locating the depth and angular direction of the resistance as follows:

(1) using said tube as a guide, determining the depth of the resistance; and, (2) using said cigar band and said registration mark as guides, determining the angular direction of the resistance.

7. The method of claim 6, further including:

after locating said depth and said angular direction of the resistance, removing said tube from said cigar and re-inserting said tube along said angular direction toward the resistance;

moving said tube longitudinally back and forth; and, operating said air supply to determine if the resistance has been eliminated.

* * * * *

UNITED STATES PATENT AND TRADEMARK OFFICE

CERTIFICATE OF CORRECTION

PATENT NO. : 8,156,943 B1
APPLICATION NO. : 12/455526
DATED : April 17, 2012
INVENTOR(S) : Craig A. Bray It is certified that error appears in the above-identified patent and that said Letters Patent is hereby corrected as shown below:

Col 7, line 57 add an --a-- at the beginning of the line, and change “enter” to --entry--, so that the line now reads:

a tube having a first end having an air entry aperture, an

Signed and Sealed this
Twelfth Day of June, 2012

David J. Kappos

David J. Kappos
*Director of the United States Patent and Trademark Office*